United States Patent [19]

Bednar

[11] Patent Number: 5,010,956

[45] Date of Patent: Apr. 30, 1991

[54] SUBSEA TREE CAP WELL CHOKE SYSTEM

[75] Inventor: John M. Bednar, Harvey, La.

[73] Assignee: Exxon Production Research Company, Houston, Tex.

[21] Appl. No.: 500,438

[22] Filed: Mar. 28, 1990

[51] Int. Cl.[5] ..... E21B 34/04; E21B 43/01

[52] U.S. Cl. ..... 166/344; 166/365; 166/368

[58] Field of Search ..... 166/340, 344, 339, 363, 166/365, 368

[56] References Cited

U.S. PATENT DOCUMENTS 4,210,208 7/1980 Shanks ..... 166/352
4,405,016 9/1983 Best ..... 166/344 X
4,589,493 5/1986 Kelly et al. ..... 166/341
4,848,473 7/1989 Lochte ..... 166/344

*Primary Examiner*—William P. Neuder
*Attorney, Agent, or Firm*—C. Milton Fick

[57] ABSTRACT

A choke arrangement useful in subsea completions in a subsea tree cap. The subsea choke arrangement allows for refitting of existing subsea tree arrangements to allow for the installation of a choke arrangement that can be easily maintained and removed. Also, a choke arrangement is shown that allows the choke to be isolated after failure which permits continued production of the well until repair or replacement operations can be implemented.

2 Claims, 1 Drawing Sheet

SUBSEA TREE CAP WELL CHOKE SYSTEM

FIELD OF INVENTION

The present invention relates generally to equipment useful in subsea production of oil, natural gas, and other wellbore fluids from a subsurface formation. More specifically, this invention concerns an improved tree cap subsea choke arrangement which reduces installation and maintenance requirements of a subsea choke system for a subsea satellite or manifold well.

BACKGROUND OF INVENTION

During the production of oil, natural gas and other wellbore fluids from a subsurface environment, it is frequently necessary to control the rate at which such fluids are produced from a wellbore. For many years, in both onshore and offshore production operations, pressure control assemblies (also referred to as "chokes") have been used with a well's valving and piping arrangements to help control production rates.

In onshore operations, the choke is installed on the surface valves and piping of a wellbore (also collectively known as a "tree") and is readily accessible by oilfield crews for maintenance. During maintenance, the choke simply is isolated from the tree and then removed for maintenance or replacement by the crew as necessary. However, in offshore operations where the tree and choke assembly are located in a subsea environment, the choke is not so readily accessible for removal by an oilfield crew. Accordingly, it is difficult to access and maintain or replace a subsea choke.

In a subsea production environment, there are various tree configurations that incorporate a choke assembly. In the most typical subsea arrangement, the choke body is incorporated into the tree piping. This arrangement requires the entire tree to be removed in order to retrieve and service the choke. In another design, the choke may have an insert design that allows the choke internals to be removed for maintenance. However, if the choke body is damaged, replacement of the choke body requires removal of the tree. A third choke design uses pre-installed connector assembly in which the complete choke assembly may be removed by a remotely operated vehicle without requiring the entire tree to be retrieved. Such a system is described in U.S. Pat. No. 4,589,493, issued to T. P. Kelly et. al. May 20, 1986.

A fourth type of subsea choke arrangement is described in U.S. Pat. No. 4,848,473, issued to G. E. Lochte July 18, 1989. In this patent, the choke and associated piping is mounted on top of the subsea tree in a piece of piping called a tree cap. The advantages of this design is that the entire choke assembly may be retrieved, repaired, and reinstalled without removing the entire tree from the subsea environment.

The Lochte patent includes a tree cap having three flow passages completely through the tree cap. These passages include a production stream conduit, a production return conduit, and an annulus connection conduit. Although the Lochte application is a significant improvement over previously existing subsea choke arrangements, the Lochte design has additional piping and valving requirements that are avoided through the improved tree cap and piping arrangement designs disclosed herein. Also, the Lochte embodiment requires three flow passages through the tree cap, as opposed to only two passages needed in the tree cap of the design disclosed herein. Also, the Lotche embodiment requires use of a workover riser embodying three vertical conduits, as opposed to only two conduits needed in the improved design disclosed herein. Additionally, in one of the embodiments described herein, it is possible to continue producing the well even after the choke experiences a failure, by isolating the failed choke from the main production flowstream. This improved design offers a significant advantage in the use of the described subsea choke system.

SUMMARY OF THE INVENTION

The present invention is directed to an improved tree cap subsea choke arrangement that reduces installation and maintenance requirements of a subsea choke system for a subsea satellite or manifold well. The subsea choke system of the Present invention comprises a wellhead connector having a first connector passage in communication with production tubing in a wellbore and a second connector passage in communication with an annulus in a wellbore, a tree flow passage connected to the wellhead connector, a tree annulus passage connected to the wellhead connector, a tree cap having a tree cap flow passage in communication with the tree flow passage and a choke return passage in communication with the annulus passage, a choke connected to the tree cap allowing fluids to flow through the tree cap flow passage through the choke and then through the choke return passage, and a production line to receive fluid from the choke return flow passage.

During operations, produced fluids flow through the first connector passage in the wellhead connector and through a valve arrangement to the tree cap. The produced fluids then flow through the choke back into the tree cap and on to the production facilities.

Another preferred embodiment of the present invention allows the choke to direct the fluid flow from the tree body back through a hub connection and on to the production facilities.

BRIEF DESCRIPTION OF DRAWINGS

For better understanding of the present invention, reference may be had to the drawings in which.

These drawings are not intended in any way to limit the present invention, but are provided solely for the purposes of illustrating certain preferred embodiments and applications of the present invention.

DESCRIPTION OF THE PREFERRED EMBODIMENTS

The present invention is an improved tree cap design and piping arrangement useful in a subsea production system requiring a subsea choke. The improved design and piping arrangement allow a choke to be incorporated into or removed from a subsea tree without requiring significant changes in an existing, typical tree design. In a preferred embodiment, the tree cap is mounted on the tree and directs wellbore fluid flow through the tree cap to a choke assembly. The choke assembly then directs the wellbore fluid back down through the tree cap to a gathering system or production facility. In another preferred embodiment, the tree cap is again mounted on the tree and directs the wellbore fluid through the tree cap to a choke assembly and to a return hub connection to a gathering system or production facility.

Figure 1:
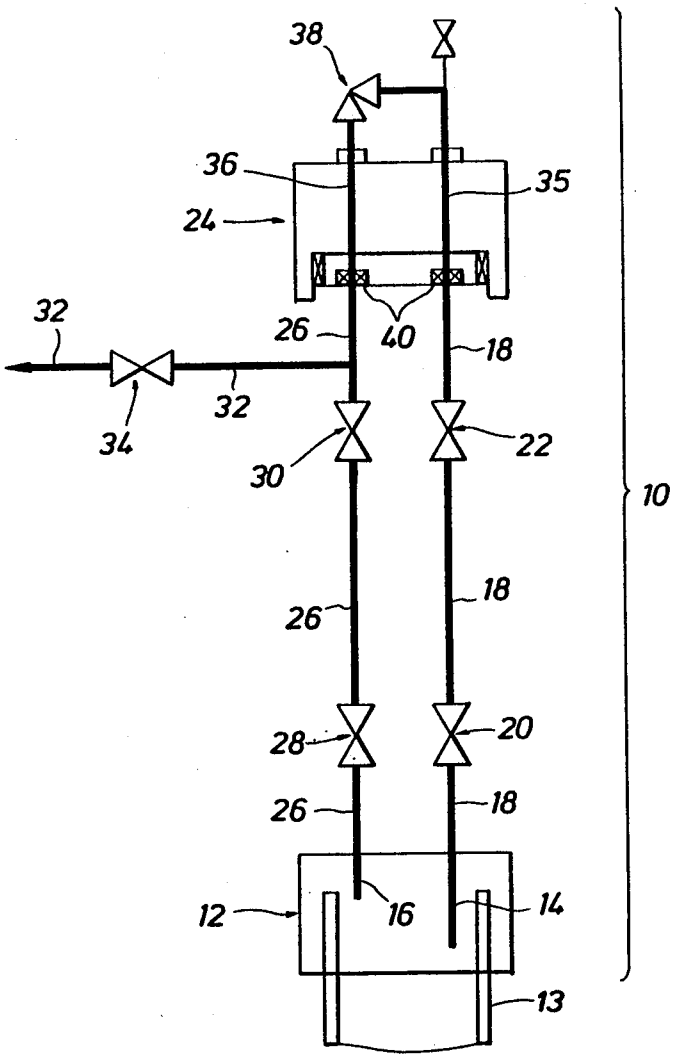
FIGURE 1 shows a schematic of a preferred embodiment of the apparatus of this invention.

FIG. 1 shows a schematic of a preferred embodiment of the present invention. In FIG. 1, subsea tree assembly 10 is mounted on wellhead connector 12. Wellhead connector 12 is typically connected to a wellhead 13 which supports the wellbore's casing via casing hangers (not shown). In a subsea location, wellhead connector 12 and wellhead 13 may be located in up to thousands of feet of water. In addition to the casing, wellhead 13 supports the well's production tubing (not shown) through which the wellbore fluids are produced. A wellbore annulus is formed between the production casing and tubing. The production casing, tubing, and wellbore annulus are not shown in FIG. 1.

The wellhead connector 12 typically allows a production flowpath in the tubing and a flow access path in the casing-by-tubing annulus to be connected to corresponding flowpaths in the subsea tree assembly 10. Extending through wellhead connector 12 are connector passage 14 and connector passage 16. Connector passage 14 allows wellbore fluid to flow from the production tubing of the wellbore through wellhead connector 12 to tree flow passage 18. Tree flow passage 18 extends from wellhead connector 12 through production master valve 20 and production crown valve 22 up into tree cap 24. Similarly, connector passage 16 allows communication between the wellbore annulus through wellhead connector 12 to tree annulus passage 26. Tree annulus passage 26 extends from wellhead connector 12 through annulus master valve 28 and annulus crown valve 30 up into tree cap 24.

In a typical tree configuration, tree flow passage 18 and tree annulus passage 26 are pipe sections or bores through a composite block. Connected to tree annulus passage 26 between annulus crown valve 30 and tree cap 24 is production line 32 and production wing valve 34. Although not shown, production line 32 continues through production wing valve 34 to a manifold or flow line for the gathering of the produced fluids.

At the point tree flow passage 18 attaches to tree cap 24 is tree cap flow passage 35. Likewise, at the point annulus passage 26 attaches to tree cap 24 is choke return passage 36. Mounted on tree cap 24 is choke 38. Tree cap flow passage 35 extends through tree cap 24 and allows wellbore fluid to move through tree cap 24 to choke 38. From choke 38, wellbore fluid is directed back through tree cap 24 through choke return passage 36 to the uppermost section of tree annulus passage 26.

Tree cap flow passage 35 and choke return passage 36 are connected to tree flow passage 18 and annulus passage 26 respectively by seal assemblies 40. Seal assemblies 40 may be any of several commercially available sealing devices suitable for this application and subsea environments. In the preferred embodiment, the tree cap incorporates a hydraulic or mechanical connector which is used to easily connect or disconnect tree cap 24 to subsea tree assembly 10, simultaneously connecting tree flow passage 18 to tree cap flow passage 35 and choke return passage 36 to tree annulus passage 26.

Figure 2:
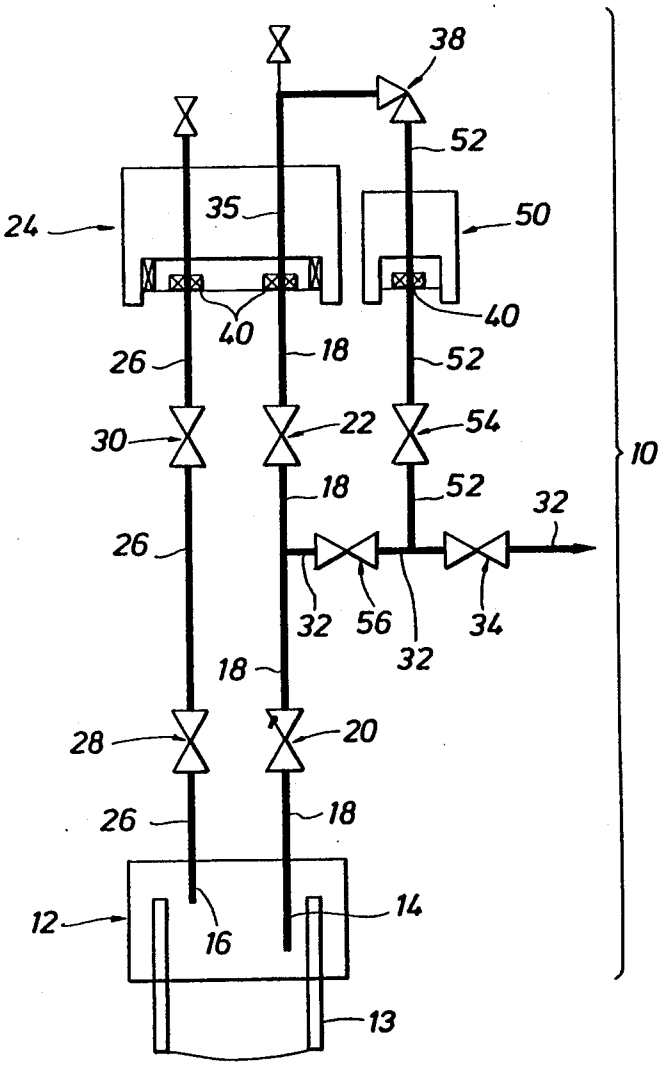
FIG. 2 shows a schematic of another preferred embodiment of the apparatus of this invention.

FIG. 2 shows another preferred embodiment of the subsea tree assembly 10 with a modified piping arrangement. Like the first described embodiment, the embodiment shown in FIG. 2 includes wellhead connector 12 and tree cap 24, and the respective passages and valves. As seen in FIG. 2, choke 38 does not direct the produced wellbore fluid back into the tree cap to choke return passage 36 as shown on FIG. 1, but rather directs the fluid to choke return hub connection 50 and back down through choke return line 52 and hub isolation valve 54. Also, connected to tree flow passage 18 between production crown valve 22 and production master valve 20 is production line 32. Production line 32 extends through flow loop isolation valve 56 and joins with choke return line 52 to production wing valve 34. As in FIG. 1, production line 32 continues through production wing valve 34 to a manifold or exiting flow line for the gathering of the produced fluids.

OPERATION AND MAINTENANCE

The operation of the subsea tree cap well choke system will now be discussed with reference to FIG. 1. During production operations through tree assembly 10 shown in FIG. 1, annulus master valve 28 and annulus crown valve 30 are closed. Production master valve 20, production crown valve 22 and production wing valve 34 are opened. Produced fluids flow from the production tubing (not shown) through first connector passage 14 in wellhead connector 12. Fluid then flows through tree flow passage 18 and valves 20 and 22 into tree cap 24 through tree cap flow passage 35. Fluid flow then continues through choke 38 and back into tree cap 24 through choke return passage 36 into tree annulus passage 26. With annulus crown valve 30 closed, produced fluid is directed through production line 32 and production wing valve 34 and onto other production facilities.

When it is necessary to perform maintenance on or replace choke 38, production crown valve 22, production master valve 20 and production wing valve 34 are shut. With annulus crown valve 30 closed, tree cap 24 and associated piping is isolated from the wellbore. With the use of hydraulically or mechanically controlled equipment, tree cap 24 may be removed and returned to the surface where choke 38 may be repaired or replaced. Alternatively, after choke 38 is removed, tree cap 24 may be replaced with a direct connection between tree cap flow passage 35 and choke return passage 36 to allow production of the wellbore without a choke installed.

After maintenance is performed on choke 38 and refitted to tree cap 24, tree cap 24 is reattached hydraulically or mechanically to subsea tree assembly 10, rejoining tree flow passage 18 to tree cap flow passage 35, and choke return passage 36 to tree annulus passage 26 through seal assemblies 40. Production master valve 20, production crown valve 22, and production wing valve 34 are then reopened and the well is brought back on production.

A significant improvement of the embodiment shown in FIG. 1 over the prior art is that installed choke 38 may be easily retrieved via tree cap 24 while requiring only two vertical boreholes in tree cap 24. This allows the use of a workover riser embodying only two vertical conduits to service the well during necessary workover operations.

The operation of the embodiment shown in FIG. 2 is similar to the operation of the embodiment in FIG. 1 discussed above, except that hub isolation valve 54 must also be opened for flow through choke 38. This allows flow from choke 38 to go directly to production line 32, instead of back through tree cap 24 and tree annulus passage 26. For maintenance, it is first necessary to isolate the tree cap 24 from the wellbore and the other production facilities. With annulus crown valve 30 and annulus master valve 28 in a closed position, production master valve 20, production crown valve 22 production wing valve 34, and hub isolation valve 54 are shut. The connector joining tree cap 24 to subsea tree assembly 10 is then released. Choke return hub connection 50 is simultaneously released.

Tree cap 24, choke 38, and the tree cap side of hub connection 50 are then brought to the surface for repair or replacement. In addition to the aforementioned ease of choke retrieval, the advantages of the arrangement shown in FIG. 2 is that the wellbore may be produced through tree assembly 10 even after subsea choke 38 experiences a failure. This may be accomplished by closing production crown valve 22 and hub isolation valve 54. Production master valve 20, flow loop isolation valve 56 and production wing valve 34 are then opened. Flow can then pass through tree flow passage 18 directly through valves 20, 56, and 34 into a manifold, flow line, or other production facilities.

It will be apparent to those skilled in the art that various changes may be made in the details and construction of the apparatus as disclosed herein without departing from the spirit and scope of the invention. Such changes and detail are included with the scope of this invention as defined in the following claims.

What I claim is:

1. An apparatus useful in subsea well completions requiring a subsea choke comprising:

a wellhead connector having a first connector passage therethrough in communication with production tubing in a wellbore and also having a second connector passage therethrough in communication with an annulus in the wellbore;

a tree flow passage connected to the wellhead connector and in communication with the first connector passage and extending through a first valve;

a tree annulus passage connected to the wellhead connector and in communication with the second connector passage and extending through a second valve;

a tree cap having:

1. a tree cap flow passage extending therethrough with the tree cap connected to and in communication with the tree flow passage at one end of the tree cap flow passage, and
2. a choke return passage extending therethrough with the tree cap connected to and in communication with the tree annulus passage at one end of the choke return passage;

a choke located on the tree cap and in communication with the tree cap flow passage and also in communication with the choke return passage whereby fluid flows through the tree cap flow passage and through the choke and then through the choke return passage; and a production line in communication with the tree annulus passage between the second valve and the tree cap and extending through a third valve.

2. An apparatus useful in subsea well completions requiring a subsea choke comprising:

a wellhead connector having a first connector passage therethrough in communication with production tubing in a wellbore and also having a second connector passage therethrough in communication with an annulus in the wellbore;

a tree flow passage connected to the wellhead connector and in communication with the first connector passage and extending through a first valve and a second valve;

a tree annulus passage connected to the wellhead connector and in communication with the second connector passage and extending through a third valve;

a tree cap flow passage extending therethrough with the tree cap connected to and in communication with the tree flow passage at one end of the tree cap flow passage, and the tree cap also connected to the tree annulus passage;

a choke connected to the tree cap and in communication with the tree cap flow passage whereby fluid flows through the tree cap flow passage and through the choke;

a choke return hub connection having a choke return passage extending therethrough;

a production line in communication with the tree flow passage between the first and second valve and extending through a fourth and fifth valve; and a choke return line connected at one end to the choke and at the other end to the production line and in communication with the choke return passage of the choke return hub connection and a sixth valve whereby fluid flows through the choke to the choke return line and through the choke return passage and the sixth valve to the production line between the fourth and fifth valve.

* * * * *